United States Patent [19]

Koerner et al.

[11] Patent Number: 4,716,812

[45] Date of Patent: Jan. 5, 1988

[54] HYDRAULIC DRIVE

[75] Inventors: Gerhard Koerner, Schriesheim; Horst Plettner, Hanau; Edelwald Lutz, Rodgau; Egon Orth, Hanau; Rudi Weingaertner, Hasselroth, all of Fed. Rep. of Germany

[73] Assignee: BBC Aktiengesellschaft Brown, Boveri & Cie, Baden, Switzerland

[21] Appl. No.: 710,036

[22] Filed: Mar. 11, 1985

[30] Foreign Application Priority Data

Mar. 10, 1984 [DE] Fed. Rep. of Germany ..... 3408909

[51] Int. Cl.[4] ..... F15B 15/17

[52] U.S. Cl. ..... 91/417 R; 60/413; 200/82 B

[58] Field of Search ..... 200/82 R, 82 B, 82 C; 340/644, 638; 73/714, 745, 753; 60/413, 415, 418, 416; 91/390, 415, 416, 417 R

[56] References Cited

U.S. PATENT DOCUMENTS

| | | | |
|---|---|---|---|
| 2,452,176 | 10/1948 | Bent . | |
| 2,989,299 | 6/1961 | Modrich . | |
| 3,426,651 | 2/1969 | Arendarski . | |
| 3,649,789 | 3/1972 | Stoll | 200/82 R |
| 3,813,994 | 6/1974 | Swander et al. | 91/416 X |
| 3,926,124 | 12/1975 | Frank | 60/416 X |
| 3,954,249 | 5/1976 | Gratzmuller | 200/82 R |
| 3,969,985 | 7/1976 | Grieger et al. | 91/416 |
| 4,205,208 | 5/1980 | Calvino | 91/415 |
| 4,535,208 | 8/1985 | Wallimann et al. | 200/82 B |

FOREIGN PATENT DOCUMENTS

| | | | |
|---|---|---|---|
| 0053574 | 6/1982 | Fed. Rep. of Germany | 91/416 |
| 2132061 | 11/1972 | France . | |
| 2000227 | 1/1979 | United Kingdom . | |
| 1546852 | 5/1979 | United Kingdom . | |

*Primary Examiner*—Edward K. Look

*Attorney, Agent, or Firm*—Herbert L. Lerner; Laurence A. Greenberg

[57] ABSTRACT

A hydraulic drive includes a pressure housing having a blind axial recess formed therein with a wall and a bottom, an accumulator piston with first and second opposite ends disposed in the recess, an energy accumulator in the form of springs disposed symmetrical to the central axis of the accumulator piston for continuously engaging the accumulator piston braced against the springs, a working piston in the form of a differential piston guided in the recess having a piston rod passing through the accumulator piston and disposed centrally in the pressure housing, the piston rod, the pressure housing and the accumulator piston defining the wall of the recess, the piston rod, the pressure housing, the first end of the accumulator piston and the working piston defining an accumulator space in the form of a hydraulic accumulator providing pressure energy for the hydraulic drive without requiring an external energy supply, the second end of the accumulator piston and the wall and the bottom of the recess defining a plenum for receiving spent hydraulic fluid at low pressure, and the accumulator piston separating the accumulator space from the plenum.

16 Claims, 7 Drawing Figures

HYDRAULIC DRIVE

The invention relates to a hydrualic drive, especially for high-voltage circuit breakers, with a working piston constructed as a differential piston guided in a blind axial recess formed in a pressure housing, one side of the working piston being continuously exposed to the force of a power accumulator and the other side being selectably acted upon by pressure or relieved of pressure.

Such a drive is known from German Published, Non-Prosecuted Application DE-OS No. 28 28 958, in which a differential piston is acted upon by hydraulic fluid from a separately disposed energy accumulator. Such a physical separation of necessity leads to the installation of pressure lines which are prone to disturbances by external influences. Depending on their length, the lines have a negative influence on the efficiency of the installation and must be installed in compliance with fire regulations which causes considerable installation costs overall.

It is accordingly an object of the invention to provide a hydraulic drive which overcomes the hereinaforementioned disadvantages of the heretofore-known devices of this general type, in which the hydraulic drive as well as the required energy accumulator including the corresponding sets are accomodated without the expensive installation of pressure lines, and which is protected against external influences.

With the foregoing and other objects in view there is provided, in accordance with the invention, a hydraulic drive, especially for high-voltage circuit breakers, comprising a pressure housing having a blind or one-sided axial recess formed therein with a wall and a bottom, an accumulator piston with first and second opposite ends disposed in the recess, an energy accumulator in the form of springs disposed symmetrical to the central axis of the accumulator piston for continuously engaging the accumulator piston braced against the springs, a working piston in the form of a differential piston guided in the recess having a piston rod passing through the accumulator piston and disposed centrally in the pressure housing, one side of the working piston being biased by the springs and the other side being selectably subjected to and relieved of pressure, the piston rod, the pressure housing and the accumulator piston defining the wall of the recess, the piston rod, the pressure housing, the first end of the accumulator piston and the working piston defining or limiting an accumulator space in the form of a hydraulic accumulator providing pressure energy for the hydraulic drive without requiring an external energy supply, the second end of the accumulator piston facing away from the accumulator space and the wall and the bottom of the recess defining or limiting a plenum for receiving spent hydraulic fluid at low pressure, and the accumulator piston separating the accumulator space from the plenum.

By applying the invention, it is possible to operate the hydraulic drive as intended at any time, i.e. even in the event of a disturbance in or interruption of the energy supply, since the drive and the energy accumulator form a structural unit.

In accordance with another feature of the invention the recess is a cylindrical bore and the pressure housing has steps formed therein forming the bore into a working cylinder with a relatively smaller diameter guiding the working piston and an accumulator cylinder with a relatively larger diameter in which the accumulator piston is guided, and including a housing lid tightly closing the cylindrical bore. This structure leads to a very compact construction since the possible storage volume in the accumulator space is a multiple of the required positioning volume for the working piston. A further advantage is the large positioning force for the working piston attainable with this structure.

Advantageously, the lid has a cup-shaped cavity which includes the plenum for the hydraulic fluid.

In accordance with a further feature of the invention, the pressure housing has an end facing away from the blind recess, and including a pressure piece disposed at the end of the housing, and transmission rods connected from the pressure piece to the accumulator piston, the springs being braced between the pressure piece and the housing and guided on the end of the housing. This is done for reducing the overall length of the hydraulic drive.

In order to avoid additional holding devices thereby simplifying the installation effort, as well as to maintain the compact structure, the spring accumulator is braced against a step formed at the nearly cylindrical pressure housing. The end of the pressure housing facing away from the housing recess has a cylindrical outer contour which serves as a sliding guide of the circular pressure piece.

In accordance with an added feature of the invention, the energy accumulator is concentric with the central axis of the accumulator piston.

In accordance with an additional feature of the invention, the energy accumulator is formed of cup spring packets. With appropriate choice of the dimensions and the pretension force, this measure has the known advantage of allowing a nearly constant force curve as plotted against the spring travel to be adjusted, so that the hydraulic accumulator has a nearly constant pressure over its entire operating range.

In accordance with again another feature of the invention, the housing lid has a side facing away from the pressure housing, and including a switch flange disposed on the side of the housing lid, and a high-voltage electric circuit breaker which can be flanged to the switch flange.

In accordance with again a further feature of the invention, there is provided a mechanical position indicator disposed in the pressure housing for indicating the position of the accumulator piston, corresponding to the available residual pressurized fluid in the accumulator space. This is provided for inspecting the respective accumulator content of the hydraulic accumulator.

In accordance with again an added feature of the invention, there is provided a coupling rigidly connected to the working piston, an electric position indicator fastened to the housing lid for indicating position of the working piston, a lever connected to the electric position indicator, a sliding piece connected from the lever to the coupling for converting translatory motion of the working piston into rotary motion of the coupling, and a visual position indicator operated by the sliding piece. This is provided for controlling the position of the working piston.

In accordance with again an additional feature of the invention, there is provided a high-pressure pump for filling the accumulator space and a hydraulic control unit for controlling motion of the working piston, both being form-lockingly integrated into the pressure housing.

In accordance with yet another feature of the invention, the pressure housing has fluid canals formed therein connecting the high pressure pump to the accumulator space and to the plenum, connecting the accumulator space to the control unit, and connecting the control unit to the working space and to the plenum. A compact construction is provided by having a high pressure pump and a hydraulic control unit integrated into the pressure housing in vicinity of the storage space which are disposed diametrically opposite each other in vicinity of the storage space, where a control slider belonging to the hydraulic control unit is disposed in a bore hole extending paralel to the central axis of the accumulator piston.

A further advantage which is obtained from this construction stems from the fact that all hydraulic connections between the pressure spaces and the high-pressure pump as well as the connections of the hydraulic control unit, are in the form of fluid canals worked into the pressure housing, so that externally installed pressure lines are eliminated. The fluid canals are constructed in such a way that hydraulic fluid is pumped from the plenum into the accumulator space and can travel from there through the three-way control unit from the storage space into a working space for the working piston as well as from the working space into the plenum. The working space is located on the side of the working piston facing away from the storage space.

In accordance with yet a further feature of the invention, the accumulator piston and the energy accumulator are rigidly coupled together.

In accordance with yet an added feature of the invention, there is provided a latching device disposed at an end of the working cylinder adjacent the accumulator cylinder for fixing the working piston in an end working position adjacent the accumulator piston. This is done to preclude unintended switching processes of the drive in the case of a pressure drop in the storage space due to trouble. The spring force of the compression spring can be set so that the latching pin slides back into its bore hole at the operating pressure of the storage space of the hydraulic fluid, because of the force acting on its protruding end face.

The switching capacity of the hydraulic drive according to the invention is set so that it meets the standards, specifications or legal regulations (for instance, ANSI, ICE/VDE) and complies reliably with the switching times and switching intervals required therein.

In accordance with yet an additional fearure of the invention, there is provided at least one external hydraulic accumulator for providing additional pressurized fluid, and a pipeline or hose line connected from the external accumulator to the accumulator space. This is used to increase the storage capacity. The accumulators are identical and are independent of an external energy supply, i.e. sets without a working pump and control unit may be provided which are connected to the hydraulic drive through suitable hydraulic lines and valves. In this way, the drive capacity can be increased practically arbitrarily and can be adapted to the user requirements. The additional space required is low due to the compact construction.

In accordance with another feature of the invention, there is provided a valve connected to the accumulator space and to the line for protecting the accumulator space against a pressure drop.

In accordance with a concomitant feature of the invention, the pressure housing includes a high-pressure pump for filling the accumulator space, the line being connected to the high-pressure pump for feeding the external accumulator.

The connecting lines may be installed rigidly, i.e. they may be fixed or flexible, such as an armored hose. According to the invention, the valves are multi-way valves and are advantageously disposed at the hydraulic drive in order to prevent a pressure drop in the storage space if connections are damaged. The location of the additional accumulator or accumulators can be determined in accordance with the prevailing local conditions.

Other features which are considered as characteristic for the invention are set forth in the appended claims.

Although the invention is illustrated and described herein as embodied in a hydraulic drive, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIGS. 1 and 1*a* are basic diagrammatic and schematic views of the hydraulic drive of the invention;

Figure 1:
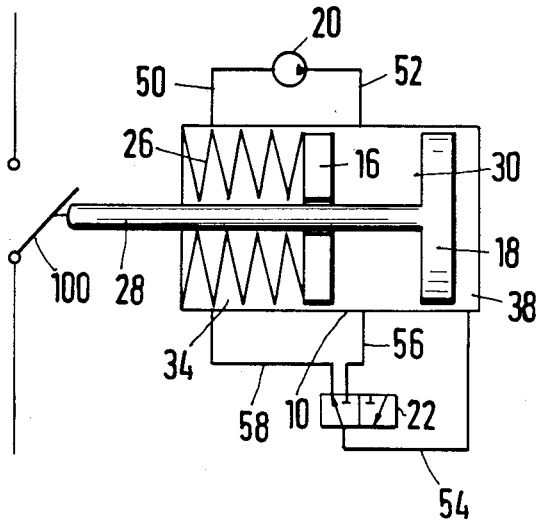

Referring now to the drawings in detail and first particularly to FIG. 1 thereof, there is seen the structure of the hydraulic drive formed by the accumulator unit and the hydraulic control element. A common pressure housing 10 contains a working piston 18 and an accumulator piston 16 which separates a plenum 34 that is acted upon by low pressure from an accumulator space 30 which is acted upon by high pressure. In the plenum 34, the accumulator piston 16 is braced against the pressure housing by a spring device 26 which is symmetrical to its central axis. The working piston 18 has a piston rod 28 which centrally and axially penetrates the accumulator piston 16 and the pressure housing 10 for actuating an electric switch 100 and the working piston 18 separates the accumulator space from a working space 38. The working space 38 can be acted upon selectably by pressure from a control unit 22 through fluid canals 54, 56 connected to the working space and the accumulator space 30, or can be relieved of the pressure through fluid canals 54, 58 connected to the working space and the plenum 34. A high-pressure pump 20 pumps pressure fluid from the plenum 34 to the accumulator space 30 through fluid canals 50, 52.

Figure 4:
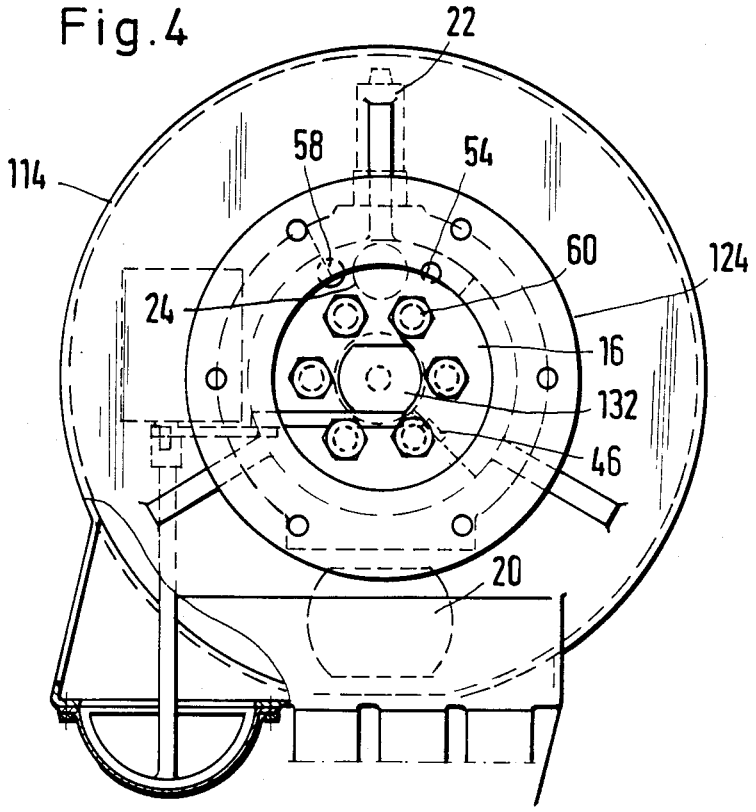
FIG. 4 is a side-elevational view of the connecting side (switch side) of the device.
Figure 2:
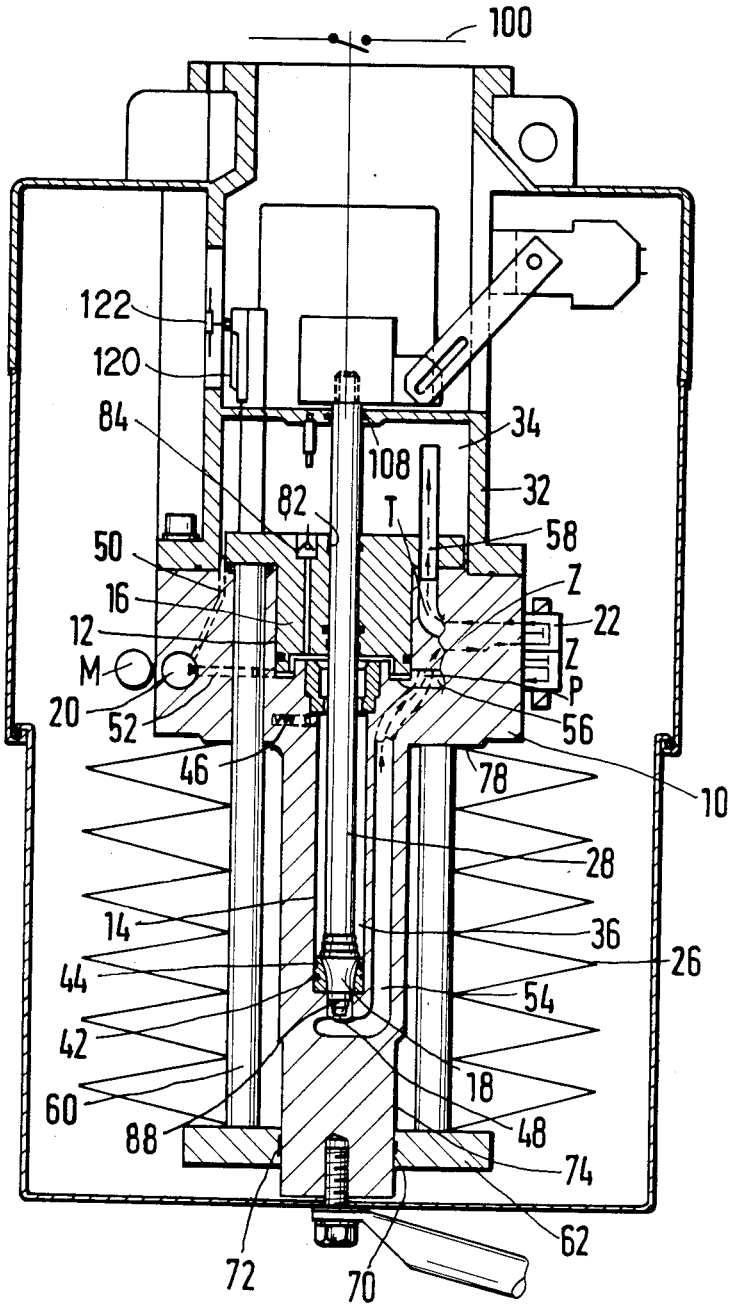
FIG. 2 is a cross-sectional view of a hydraulic drive with a hydraulic accumulator in the rest position (such as with the switch open)
Figure 3:
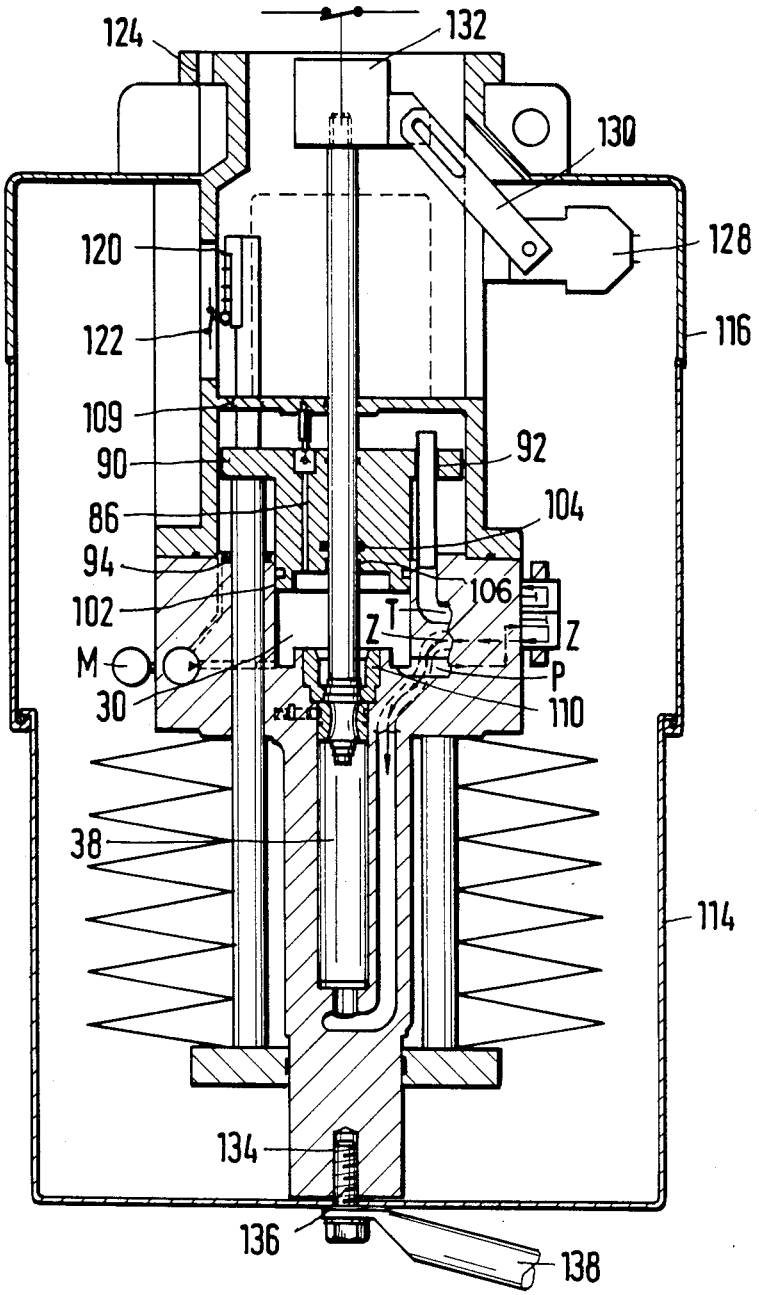
FIG. 3 is a similar cross-sectional view of a hydraulic drive with the hydraulic accumulator in the working or operating position (such as with the switch closed)

The hydraulic drive illustrated in FIGS. 2 to 4 has a pressure housing 10 with a nearly cylindrical, set-back, outer contour, in which a step-like cylindrical bore is formed in the axial direction, starting from an end face. The bore hole has a first region with a large diameter covering about ⅓ of its depth, which serves as an accumulator cylinder 12, as well as a second region with a smaller diameter which serves as a working cylinder 14. The pressure housing 10 is closed off from the outside by a flanged-on housing lid 32.

Figure 1A:
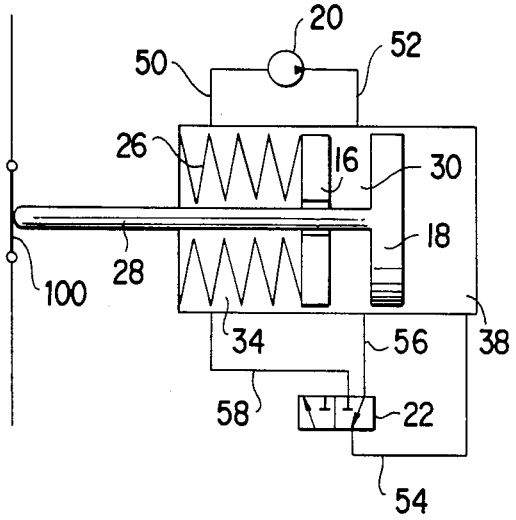

In vicinity of the accumulator cylinder 12, a high-pressure pump 20 is pressure-tightly fitted into a housing opening formed radially relative to the axis of the cylinder, by means of a circular seal. A hydraulic control unit 22 which is switched into off and on position in FIGS. 1 and 1*a* is also integrated into the pressure housing 10 in a form-locking manner, diametrically opposite the pump 20. A form-locking connection is one in which parts are locked together by virtue of their own shape, without requiring external force.

The accumulator cylinder 12 serves for receiving an accumulator piston 16 which separates an accumulator space 30 which is under high pressure from a plenum 34 which is acted upon by low pressure and is formed in the housing lid 32 which is hollowed out in cup-fashion. A drill hole 86 runs axially and eccentrically in the accumulator piston 16 and leads to an overpressure valve 84 located in the accumulator piston 16. If the operating pressure in the accumulator space 30 is exceeded, the space 30 is connected to the plenum 34 through the drill hole 86. On the side facing the plenum 34, the accumulator piston 16 has a collar 90 through which a fluid canal 58 passes eccentrically in the axial direction. The fluid canal 58 is a tube section which is pressed into a drill hole 92 formed into the pressure housing 10 eccentrically in the axial direction with sufficient play which ends in the plenum 34. Further holes are disposed symmetrically to the central axis, each of which contains a transmission rod 60.

A sliding seal 102 is disposed on the end of the accumulator piston 16 located opposite the collar 90. The sliding seal 102 is worked into the cylindrical surface of the accumulator piston 16 and seals the accumulator space 30 from the wall of the accumulator cylinder 12. The center of the accumulator piston 16 is penetrated by an axially-extending guide hole 82, in which a piston rod 28 is disposed. At least one sliding seal 104 inserted into the guide hole 82 is provided for sealing the accumulator space 30. Two sliding rings 106 serve for the exact guidance of the piston rod 28 in the guide hole 82.

Free access for the hydraulic fluid flowing from the accumulator space 30 to a working space 36, is limited to a defined cross-section by a fitted insert and an inserted impact cell 110. The piston rod 28 is undetachably connected to a working piston 18 which is constructed as a differential piston. Both surfaces of the piston have steps 88 which are tapered in ring-fashion and operate as impact dampers. The steps change over into the piston rod 28 on one side. The working piston 18 carries a piston ring at the end opposite the piston rod 28. A sliding seal 42 is worked into the cylindrical piston surface at approximately the middle of the piston, adjacent the ring. A circular slot 44 is provided in the cylinder surface of the working piston 18, on the side facing the piston rod. The contour of the slot 44 is fitted to a spring-loaded latching pin 46. A fluid canal 54 opens into the bottom 48 of the working cylinder 14. The fluid canal 54 runs parallel and axially to the working cylinder 14, and establishes a connection to the hydraulic control unit 22. The hydraulic control unit 22 is connected to the accumulator space 30 through a fluid canal 56 and the unit 22 is connected to the plenum 34 through the fluid canal 58.

The high-pressure pump 20 is connected to the plenum 34 through a fluid canal 50 and the pump 20 is connected to the accumulator space 30 through a fluid canal 52.

The spring-loaded latching pin 46 is disposed in the working cylinder 14 immediately adjacent the impact cell 110 in the radial direction. The pin 46 is in the form of a pressure-controlled latch wich is aligned with the circular slot 44 if the working piston 18 is in the operating position shown in FIG. 3.

The transmission rods 60 extend out of the pressure housing 10 in a feedthrough with a siding seal. The rods 60 connect the accumulator piston 16 to a spring device 26 through a pressure piece 62. The set back ends of the transmission rods 60 have threads and are pushed through holes in the collar 90 of the accumulator piston 16 which are matched to the thread diameter as well as through holes in the pressure piece 62, so that the collar and the pressure piece 62 are braced against the transmission rod and are each fixed by a frictional force.

The pressure piece 62 is guided by the cylindrical end of the pressure housing 10 in such a manner that an internal hole 70 in the pressure piece 62 slides on a sliding guide 74 for a reduction of the occurring friction.

The spring device 26 is stacked in alternating directions and, according to its geometry, is located and pretensioned in such a manner that a nearly constant force results over the entire working travel distance thereof. In this case, one side of the spring packets of the spring device 26 is braced against the pressure piece 62, and the other side is braced against an abutment 78 formed on the periphery of the pressure housing 10.

The piston rod 28 passes through the housing lid 32 in a central bore hole 108, with an inserted sliding seal. A mechanical piston indicator 120 for the accumulator is eccentrically brought out of the pressure housing 10 in an extension of a transmission rod 60. The mechanical position indicator 120 penetrates the housing lid in a tight sliding hole 109 which actuates an end switch 122 fastened to the housing lid 32. The embodiment further provides that the housing lid 32 has a flanged-on electric switch 100 in an extension of the pressure housing 10 at a switch flange 124. The electric switch 100 which is in the on position in FIG. 1*a* and in the off positiion in FIG. 1 can be actuated by the piston rod 28. Furthermore, the housing lid 32 is brought radially outwardly in such a manner that it serves as a hood base 116 for receiving a cover hood 114 that is detachably connected to the hood base 116 by a lock. An optical reading device 126 can be fastened to the hood base, at the height of the mechanical position indicator 120. Furthermore, an electric position indicator 128 for the working piston is connected to a coupling 132 through a lever with a gliding piece 130. The coupling serves for connecting the piston rod 28 to the electric switch 100 to be actuated. A tapped hole 134 which receives a cylindrical screw 136 for securing a holding device 138, is disposed in the housing 10 on the side facing away from the switch flange.

If the high-pressure pump 20 is switched on, hydraulic fluid is pumped through the fluid canal 50 from the plenum 34 and through the fluid canal 52 into the accumulator space 30. Due to the pressure in the accumulator space 30, which rises upon further pumping, the accumulator piston 16 moves in the direction toward the housing lid 32 until it has reached its predetermined end position. The piston 16 moves against the force which is transmitted by means of the transmission rods 60 and which results from the compression of the spring device 26. Upon a further pressure rise, the over-pressure valve 84 opens and hydraulic fluid flows from the accumulator space 30, through the hole 86, into the plenum 34.

If the fluid canals 54 and 56 are connected to each other in the hydraulic control unit 22, hydraulic fluid flows from the accumulator space 30 to the bottom 48 of the working cylinder 14, so that the same pressure is present at both piston surfaces. However, since the piston area of the working piston 18 facing the working space 38 is larger than the opposite piston area, by an amount equal to the cross-section of the piston rod 28, the working piston 18 is moved into the working position. According to the piston stroke, the piston rod 28 moves in the direction toward the switch flange 124, so that the actuation of the flanged-on electric switch 100 takes place. In order to bring the working piston 18 from the operating position into its rest position, the fluid canals 54 and 58 in the hydraulic control unit 22 are connected to each other. In this manner, the hydraulic fluid contained in the working space 38 travels into the plenum 34 through the fluid canals 54 and 58. Due to the pressure relief in the working space 38, the working piston 18 is displaced into its rest position at high speed by the accumulator pressure prevailing in the working space 38. Similarly, the piston rod 28 moves back and operates the electric switch 100 and the electric position indicator, through the lever with the sliding piece 130.

With each on/off switching process, a volume unit of hydraulic fluid corresponding to the volume of the working space 38 is used up. The required number of switching cycles that can be made available without a supply of external energy determines the size of the accumulator volume, which is stored, as explained above, with nearly constant force corresponding to nearly constant pressure. The accumulator volume present in the accumulator space 30 at any time can be read at the mechanical position indicator 120. The operation of the high-pressure pump 20 can be controlled by means of the end switch 122.

In order to prevent mechanical damage of the working piston 18 due to its quick motion from the rest position to the working position and vice versa, the impact dampers 88 mentioned above are provided.

The action of the dampers is based on the fact that the discharge cross section for the pressure fluid from the working cylinder 14 is reduced as a function of the respective position of the working piston 18. As a consequence, the pressure fluid runs out more slowly, so that the motion of the working piston 18 is slowed.

Figure 5A:
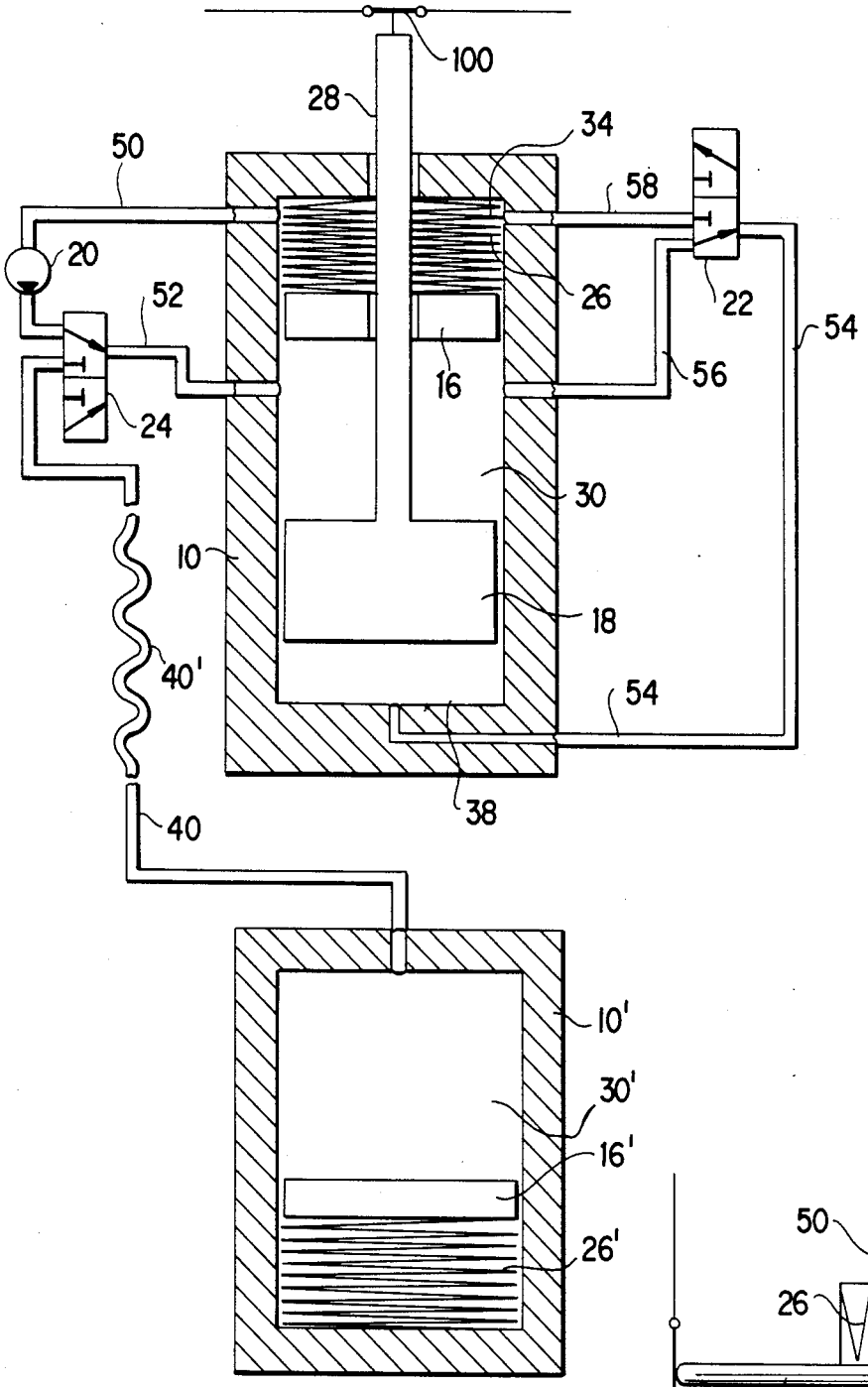
FIGS. 5*a* and 5*b* are basic diagrammatic and schematic views of the drive with an external hydraulic accumulator.
Figure 5B:
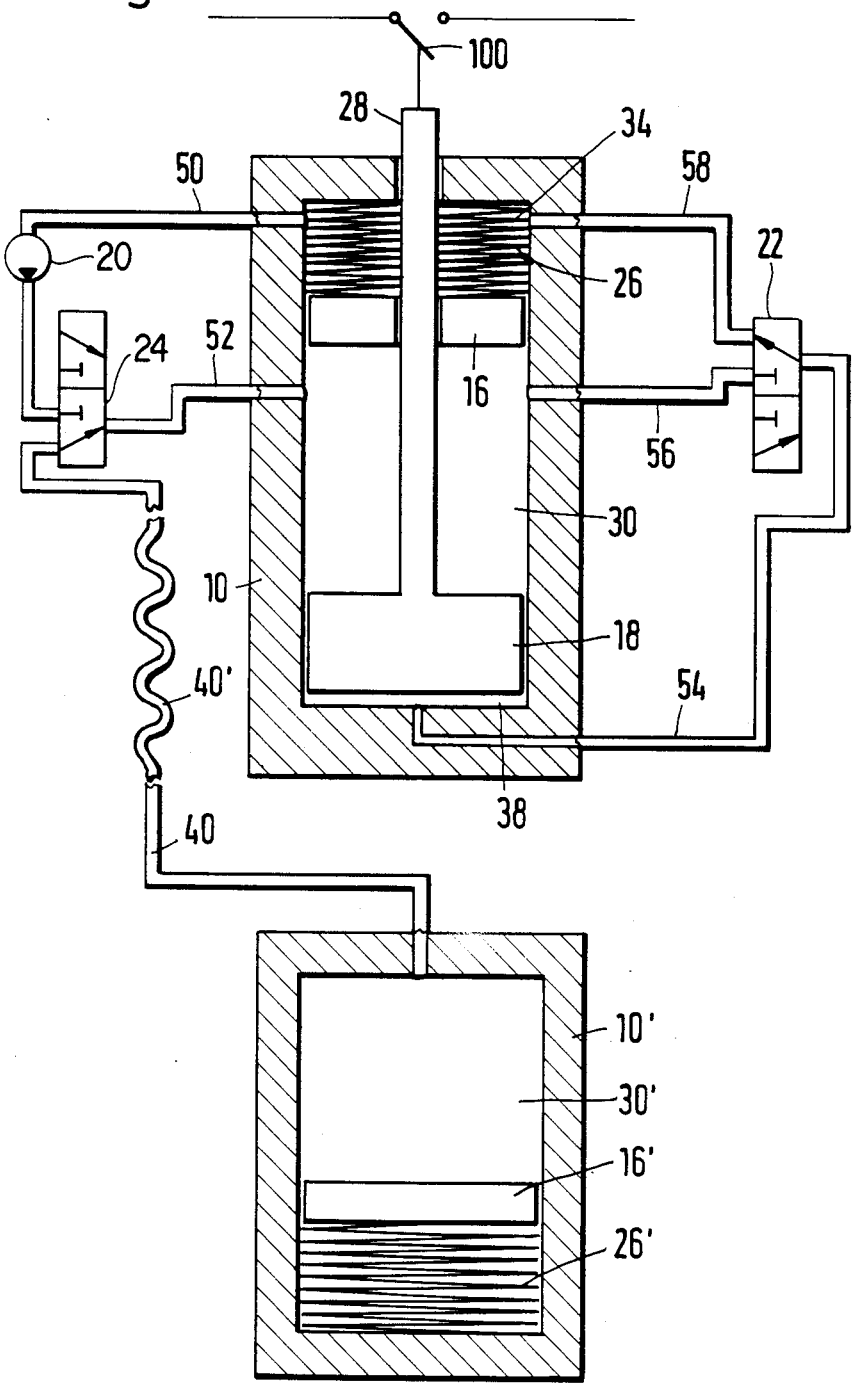

FIG. 5 schematically shows how an external hydraulic accumulator 10' is selectably connected through a connecting line in the form of a rigid pipeline 40 or a flexible hose line 40', to a multi-way valve 24. The valve 24 which is located at the hydraulic drive, connects the high-pressure pump 20 either to the accumulator space 34 or to the external hydraulic accumulator 10' depending on the position of the valve shown in FIGS. 5*a* and 5*b*. This hydraulic accumulator 10' is formed of a pressure housing 10 having the same construction as the pressure housing 10 of the hydraulic drive.

The cylindrical interior of the accumulator is subdivided by an accumulator piston 16' into an accumulator space 30' and a second region which contains the spring device 26', representing the storage element.

In the embodiment, the supply with pressurized fluid from the high pressure pump 20 is provided through the connecting line (40, 40''), where the interposed multi-way valve protects the accumulator space 30 against a pressure drop.

As far as the circuit is concerned, if required, the pressurized fluid contained in the external hydraulic accumulator flows into the accumulator space 30 due to the stored force emanating from the spring arrangement 26', so that an additional number of switching cycles is assured.

The foregoing is a description corresponding in substance to German application No. P 34 08 909.8, filed Mar. 10, 1984, the International priority of which is being claimed for the instant application, and which is hereby made part of this application. Any material discrepancies between the foregoing specification and the aforementioned corresponding German application are to be resolved in favor of the latter.

We claim:

1. Hydraulic drive, comprising a pressure housing having a blind axial recess formed therein with a wall and a bottom, an accumulator piston with first and second opposite ends disposed in said recess, an energy accumulator in the form of springs disposed symmetrical to the central axis of said accumulator piston for continuously engaging said accumulator piston braced against said springs, a working piston in the form of a differential piston guided in said recess having a piston rod passing through said accumulator piston and disposed centrally in said pressure housing, a high-pressure pump communicating with said accumulator space for filling said accumulator space, a hydraulic control unit for controlling motion of said working piston, said piston rod, said pressure housing and said accumulator piston defining said wall of said recess, said piston rod, said pressure housing, said first end of said accumulator piston and said working piston defining an accumulator space in the form of a hydraulic accumulator providing pressure energy for the hydraulic drive, said second end of said accumulator piston and said wall and said bottom of said recess defining a plenum for receiving spent hydraulic fluid at low pressure, and said accumulator piston separating said accumulator space from said plenum.

2. Hydraulic drive according to claim 1, wherein said recess is a cylindrical bore and said pressure housing has steps formed therein forming said bore into a working cylinder with a relatively smaller diameter guiding said working piston and an accumulator cylinder with a relatively larger diameter in which said accumulator piston is guided, and including a housing lid tightly closing said cylindrical bore.

3. Hydraulic drive according to claim 2, including a latching device disposed at an end of said working cylinder adjacent said accumulator cylinder for fixing said working piston in an end working position adjacent said accumulator piston.

4. Hydraulic drive according to claim 2, wherein said high-pressure pump and said hydraulic control unit are both integrated into said pressure housing.

5. Hydraulic drive according to claim 4, wherein said pressure housing has fluid canals formed therein connecting said high pressure pump to said accumulator space and to said plenum, connecting said accumulator space to said control unit, and connecting said control unit to said working space and to said plenum.

6. Hydraulic drive according to claim 1, wherein said accumulator piston and said energy accumulator are rigidly coupled together.

7. Hydraulic device according to claim 1, wherein said pressure housing has an end facing away from said blind recess, and including a pressure piece disposed at said end of said housing, and transmission rods connected from said pressure piece to said accumulator piston, said springs being braced between said pressure piece and said housing and guided on said end of said housing.

8. Hydraulic drive according to claim 1, wherein said energy accumulator is concentric with the central axis of said accumulator piston.

9. Hydraulic drive according to claim 8, wherein said energy accumulator is formed of cup spring packets.

10. Hydraulic drive according to claim 2, wherein said housing lid has a side facing away from said pressure housing, and including a switch flange disposed on said side of said housing lid, and a high-voltage electric circuit breaker connected to said switch flange.

11. Hydraulic drive according to claim 1, including a mechanical position indicator disposed in said pressure housing for indicating the position of said accumulator piston, corresponding to the available residual pressurized fluid in said accumulator space.

12. Hydraulic drive according to claim 2, including a coupling rigidly connected to said working piston, an electric position indicator fastened to said housing lid for indicating position of said working piston, a lever connected to said electric position indicator, a sliding piece connected from said lever to said coupling for converting translatory motion of said working piston into rotary motion of said coupling, and a visual position indicator operated by said sliding piece.

13. Hydraulic drive according to claim 1, including at least one external hydraulic accumulator for providing additional pressurized fluid, and a line connected from said external accumulator to said accumulator space.

14. Hydraulic drive according to claim 13, including a valve connected to said accumulator space and to said line for protecting said accumulator space against a pressure drop.

15. Hydraulic drive according to claim 13, wherein said pressure housing includes a high-pressure pump for filling said accumulator space, said line being connected to said high-pressure pump for feeding said external accumulator.

16. Hydraulic drive according to claim 1, wherein said pressure housing has a central axis and a cylindrical end, and including a pressure piece guided on said cylindrical end and connected to said energy accumulator, and transmission rods disposed symmetrical to said central axis of said pressure housing, said transmission rods being connected between said accumlator piston and said pressure piece.

* * * * *